United States Patent [19]

Shanks

[11] 4,447,862

[45] May 8, 1984

[54] SEALED BEAM LAMP UNIT SEALING SURFACES

[75] Inventor: Bruce E. Shanks, Chesterland, Ohio

[73] Assignee: General Electric Company, Schenectady, N.Y.

[21] Appl. No.: 365,435

[22] Filed: Apr. 5, 1982

[51] Int. Cl.[3] ..... F21V 29/00

[52] U.S. Cl. ..... 362/267; 362/61; 362/83; 362/307; 362/310; 362/311; 362/375; 313/113

[58] Field of Search ..... 362/267, 61, 83, 307, 362/310, 311; 313/113

[56] References Cited

U.S. PATENT DOCUMENTS 4,240,131 12/1980 Albrecht ..... 362/267

*Primary Examiner*—Stephen J. Lechert, Jr.

*Attorney, Agent, or Firm*—John F. McDevitt; Philip L. Schlamp; Fred Jacob

[57] ABSTRACT

An adhesively sealed beam lamp unit including a lens and reflector preferably having substantially rectangular peripheries and cooperating and opposing sealing surfaces located approximately about the lens and reflector peripheries. Contact between the lens and reflector sealing surfaces is limited to one or more portions along the sides thereof. Additionally reservoirs, located adjacent to the sealing surfaces restrict excess adhesive from spreading onto areas affecting lamp unit optical performance, outer dimensions, and integrity.

9 Claims, 4 Drawing Figures

SEALED BEAM LAMP UNIT SEALING SURFACES

CROSS-REFERENCE TO RELATED APPLICATIONS

U.S. Pat. Application Ser. No. 346,302, now U.S. Pat. No. 4,425,606 Joseph P. Marella and Bruce E. Shanks, for "Sealed Beam Lamp Unit" and assigned the same as this invention.

U.S. Pat. Application Ser. No. 346,303, now U. S. Pat. No. 4,425,607 Bruce E. Shanks for "Improved Sealed Beam Lamp Unit" and assigned the same as this invention.

BACKGROUND OF THE INVENTION

The present invention is related to lamps, particularly sealed beam lamp units, having two-piece envelopes comprising a reflector and lens assembled by adhesive means. The reflector has an internal reflective coating for reflecting and directing light, originating from a light source located within the envelope, towards a cooperating lens through which the light is transmitted. Such sealed beam lamps have particular utility and are commonly used as headlights for motor vehicles.

Lamp units, such as headlights, reently have been introduced with lenses and reflectors having rectangular shaped peripheries, supplanting the more familiar circular units. Production of assembled rectangular glass reflectors and lenses, however, can present numerous problems. For example, stresses created in the glass lenses and reflectors during assembly by fusion sealing can cause cracking thereof. Such stresses can be significantly reduced by using an adhesive, rather than fusion, to seal the glass reflector and lens together. However, the ambient temperature, particularly at cold temperatures, can produce additional stresses due to the differences in the coefficients of expansion between glass and adhesive resulting in cracks, especially about the reflector corners. Thus, the inherent problem remains of thermally induced stresses experienced when dissimilar materials, such as glass and adhesive, are joined.

Additionally, adhesively bonded lamps, which are generally made from moldable materials, and especially from glass, are very susceptible to flaws. More particularly, in the manufacture of the lamp unit, moldable materials such as, but not limited to, glass typically have flaws on the surfaces thereof. If the adhesive, which seals the reflector and lens together, is in contact with these flaws, the adhesive at cold temperatures will contact at a different rate than the glass and thereby place stress on one of the weaker portions of the glassware, namely the flaws. Thus the inherent problem of thermally induced stresses experienced when dissimilar materials are joined is aggravated by adhesive contact with flawed areas.

Furthermore, if any portion of the adhesive flows onto the light-transmitting area of the lens or light-reflecting area of the reflector, or beyond the lamp unit periphery during assembly of the unit, undesirable and unacceptable lamp unit optical performance and/or peripheral dimensions can result. Still further, due to the prior art sealing surfaces shapes, more adhesive than desired is required.

Prior art lamp units also require a relatively high adhesive flexibility to reduce tearing or spalling of the adhesive due to the different coefficients of expansion for glass and adhesive. Such high adhesive flexibility is achieved through the addition of flexibilizers in the adhesive. Flexibilizers, however, undesirably increase the permeability of the adhesive resulting in moisture penetration leading to filament and lamp degradation.

SUMMARY OF THE INVENTION

In view of the foregoing, it is an object of the present invention to provide a new and improved, substantially rectangular shaped, adhesively sealed beam lamp unit by reducing the stresses generated about the sealing surfaces thereof.

Another object of the present invention is to provide a new and improved, substantially rectangular shaped, adhesively sealed beam lamp unit having means to ensure that excess adhesive does not undesirably affect lamp unit optical performance or dimensions.

Another object of the present invention is to provide a new and improved, substantially rectangular shaped, adhesively sealed beam lamp unit having means which avoid adhesive contact of lamp unit surface flaws.

Another object of the present invention is to provide a new and improved, substantially rectangular shaped adhesively sealed beam lamp unit requiring less adhesive than prior art lamp units.

Another object of the present invention is to provide a new and improved, substantially rectangular shaped adhesively sealed beam lamp unit which is more resistant to moisture penetration than prior art lamp units.

These and other objects of the present invention are achieved by providing a lamp unit comprising a reflector and lens having preferably substantially rectangular peripheries and cooperating and opposing sealing surfaces, located approximately about the lens and reflector peripheries, with adhesive disposed thereon and substantially contained therebetween. Contact between the lens and reflector sealing surfaces is limited to one or more portions along the sides thereof. Additionally, to restrict adhesive from flowing onto optically undesirable areas of the lens and/or reflector, to maintain acceptable lamp unit outer dimensions, and to avoid adhesive contact of lamp unit surface flaws, reservoirs, located adjacent to the sealing surfaces, are provided.

DETAILED DESCRIPTION

Figure 1:
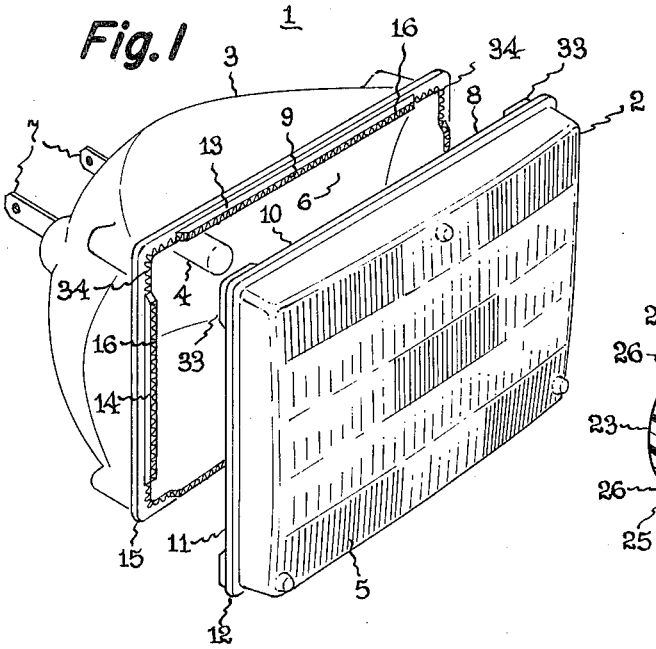
FIG. 1 illustrates a perspective view of a rectangular lamp unit in accordance with the present invention.

FIG. 1 illustrates a rectangular lamp unit such as a headlamp unit 1 having a lens 2, cooperating reflector 3 and light source 4. Both lens 2 and reflector 3 can be formed by pressing "hard" glass in a mold followed by an annealing process. The lens 2 and/or reflector 3 also can be made from other materials such as, but not limited to, quartz and plastic. Lens 2 typically has a slightly convex outer face and an optical prescription provided, for example, by light refracting prisms 5 formed on the inside surface thereof. Additionally, the concave inner surface 6 of the reflector 3 has a light-reflective coating typically comprised of aluminum or silver. At the outer rear of the reflector 3 are conventional electrical prongs 7, providing an electrical path through which power is supplied to the unit 1.

As further illustrated in FIG. 1, lens 2 and reflector 3 have substantially rectangular peripheries and sealing surfaces 8 and 9 located approximately about these peripheries, respectively. Lens 2 has longer sides 10, shorter sides 11, and corners 12. Likewise, reflector 3 has corresponding longer sides 13, shorter sides 14 and corners 15.

As previously discussed, fusion sealing induced, for example, by a flame trained on the glass reflector and lens sealing surfaces 8 and 9, can create unacceptable stress patterns, in particular, with stresses tending to concentrate about the reflector corners 15, resulting in cracks especially thereat. The stresses created by flame sealing are substantially eliminated by interposing an adhesive 16 between the peripheral sealing surfaces 8 and 9 to seal the lens 2 to the reflector 3. For example, a light-curable, flexibilized epoxy, such as disclosed in U.S. Pat. No. 4,240,131, incorporated herein by reference thereto, provides a reliable seal between the glass lens 2 and glass reflector 3. Another example of an acceptable adhesive is "UNISET 929" which is a heat-curable adhesive sold by Amicon Corp. of Lexington, Massachusetts.

Figure 2:
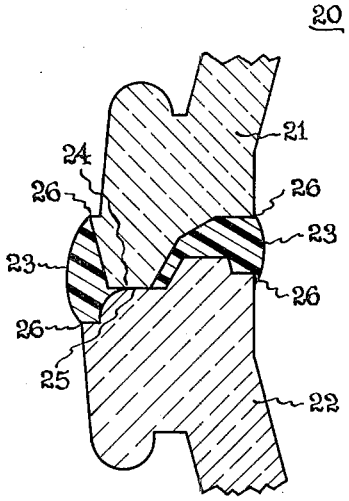
Fig. 2 (PRIOR ART)
FIG. 2 illustrates a fragmentary, cross-sectional view of prior art lens and reflector sealing surfaces.

Although adhesive sealing substantially eliminates stresses created by fusion sealing, an additional type of stress due to thermal affects remains. For example, FIG. 2 illustrates a cross-sectional view of a prior art, adhesively sealed beam lamp unit 20, comprising a glass lens sealing surface 21 and a glass reflector sealing surface 22 with adhesive 23 disposed thereon and therebetween. The sealing surfaces 21 and 22 are located about the rectangular peripheries of the glass lens and reflector respectively. During assembly of the lamp unit 20, adhesive 23 is placed between the sealing surfaces 21 and 22. When pressure is applied to the sealing surfaces 21 and 22, during the manufacturing process of the lamp unit 20, a significant amount of adhesive 23 between the outermost sealing surface sections 24 and 25 is pressed away therefrom resulting in contact therebetween and especially around the corners of the lamp unit 20. Such contact can create unacceptable stress patterns, particularly around the reflector corners. Additionally, the adhesive 23 when forced from between sealing surface sections 24 and 25 can flow beyond the designed lamp unit outer dimensions resulting in an oversized and unacceptable lamp unit.

Furthermore, contact between sealing surface sections 24 and 25 is aggravated by the different coefficients of thermal expansion of glass and adhesive. For example, the coefficient of thermal expansion for borosilicate glass, conventionally used in sealed beam automotive headlamps, typically is about $40\times10^{-7}$ cm/cm/°C. whereas the coefficient of thermal expansion of a typical flexibilized epoxy, suitable for sealing lamp glassware, typically is about $40\times10^{-6}$ cm/cm/°C. That is, the coefficients of thermal expansion of glass and adhesive, in a sealed beam lamp unit can differ, by a factor of about 10. Therefore, temperature changes, in particular decreasing temperatures, produce different rates of contraction for the glass and interposed adhesive creating more stress between the sealing surfaces and thereby aggravating the glass lens to glass reflector contact along those outermost sealing surface sections 24 and 25 where the adhesive has been pressed away. In certain instances, spalling of the adhesive and glass can occur. Even worse, the glassware can crack producing unacceptable lamp performance.

Adhesively bonded lamps are generally made from moldable materials such as glass. In the making of the lamp units, flaws typically appear on the surfaces thereof. More specifically, certain flaws are created due to the misalignment of the tooling pieces used in the molding of the lamp units. That is, when two or more of the tooling pieces are pressed together, to obtain a desired molded shape, a misalignment therebetween or thereamong provides discontinuities or flaws on the surface of the molded material. Such flaws, referred to within the art as match-lines or parting lines, are shown in FIG. 2 as lamp unit portions 26. If the adhesive 23 comes into contact with these match-lines 26 and if the ambient temperature is reduced, the adhesive will contract at a different rate than the glass due to the differences in the coefficients of expansion thereof and thereby place stress on portions of the glassware highly susceptible to stress induced failure, that is, the match-lines 26, resulting in cracks thereat and jeopardizing the glassware integrity.

Figure 3:
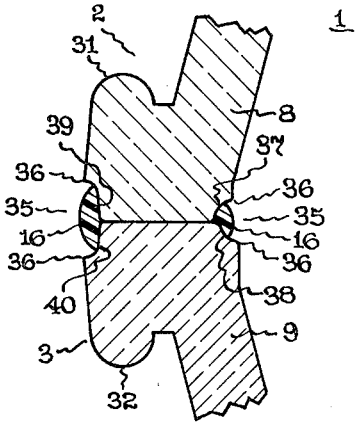
FIG. 3 illustrates a fragmentary, cross-sectional view of lens and reflector sealing surfaces along the sides thereof in accordance with the present invention.

In contrast thereto, the present invention significantly reduces the above-mentioned stresses, especially around the reflector corners 15, by modifying such unacceptable stress patterns. FIG. 3 which is a fragmentary, cross-sectional view of the lens and reflector sealing surfaces 8 and 9, respectively, along the sides of the lamp unit 1, illustrates the present invention in detail. Lamp unit 1 includes on the edges of the lens 2 and reflector 3 external molding lobes 31 and 32, respectively, which aid in the molding thereof. Both lens sealing surface 8 and reflector sealing surface 9, which are approximately located about the periphery of the lens 2 and reflector 3, respectively, cooperate with and oppose each other and are preferably substantially planar in shape and substantially transverse to the lamp unit axis.

As shown in FIG. 1, part of the lens sealing surface 8 comprises protrusions 33, referred to hereinafter as keys, located substantially about the corners thereof with cooperating and opposing indentations 34, referred to hereinafter as key recesses, located substantially about the corners of the reflector sealing surface 9. Alternatively, the keys 33 can be located on the reflector sealing surface 9 and the key recesses 34 located on the lens sealing surface 8. In a preferred embodiment the length of each key or key recess comprises approximately 3.5% of the total lamp unit perimeter as measured at the junction of the sealing surfaces. Alternatively, the length of each key and key recess pair can vary from pair to pair which advantageously can be used to assure proper orientation of the lens 2 to the reflector 3.

Lamp unit 1 can be assembled by disposing the adhesive 16, such as a heat curing adhesive, on and between the sealing surfaces 8 and 9. The lens 2 and reflector 3 are then pressed together, such that opposing sides and corners are mated with each other to thereby cooperate with and oppose each other. The lens-reflector assembly is then placed in an oven and brought to and kept at a requisite curing temperature until the adhesive is cured. As sealing surfaces 8 and 9 are pressed together and/or during curing of the adhesive, adhesive 16 substantially covers and is substantially contained therebetween.

As shown in FIG. 3, reservoirs 35 located adjacent to the sealing surfaces 8 and 9 retain any excess adhesive, which oozes from therebetween and thereby prevent the adhesive 16 from spreading onto undesirable portions of the lamp unit 1. That is, the reservoirs 35 enable application of sufficient adhesive to ensure an acceptable peripheral seal without such adhesive oozing onto the lens light-transmitting portions, such as the lens prism 5, and/or beyond the designed lamp unit outer periphery. Furthermore, the reservoirs serve to keep the adhesive 16 away from the match-lines 36 of the lamp unit 1. Thus the adhesive 16 avoids contacting portions of the glassware which are less able to successfully withstand stresses exerted by the adhesive.

The reservoir on each side of the sealing surfaces is formed by joining curved surfaces 37–38 and 39–40 together. As illustrated in FIG. 3, curved surfaces 37 and 38 need not have the same curvature as 39 and 40. Additionally, that portion of each reservoir adjacent to each sealing surface need not form a substantially continuous curved surface with that portion of the reservoir which cooperates and opposes it. For example, curved surface 37 does not form a substantially continuous surface with curved surface 38.

During assembly of the lamp unit 1, keys 33 and key recesses 34 serve several functions. First by pairing together, the keys 33 and key recesses 34 aid in the alignment of lens 2 to reflector 3. Additionally, by fitting together, the keys 33 and key recesses 34 prevent the lens 2 from slipping off the reflector 3 and thereby restrict lateral movement of lens 2 relative to reflector 3. Most importantly, and as will be discussed below, the keys 33 and key recesses 34 serve to alter the stress pattern experienced in prior art, adhesively sealed beam lamp units and thereby substantially reduce the number of cracks that can occur, especially about the lamp unit corners.

Of particular note, and as shown in a cross section view of the lamp unit sides, FIG. 3 illustrates that between the sealing surfaces 8 and 9 a thin layer of adhesive 16 exists. The adhesive layer, however, can be so thin that pockets, void of adhesive, can form therein resulting in lens-reflector contact thereat. Such pockets are due to adhesive 16 having been pressed away from between the sealing surfaces sides during assembly of the lamp unit 1. It is to be emphasized, however, that such lens-reflector contact is limited specifically to one or more portions along cooperating sides 10–13 and 11–14.

Figure 4:
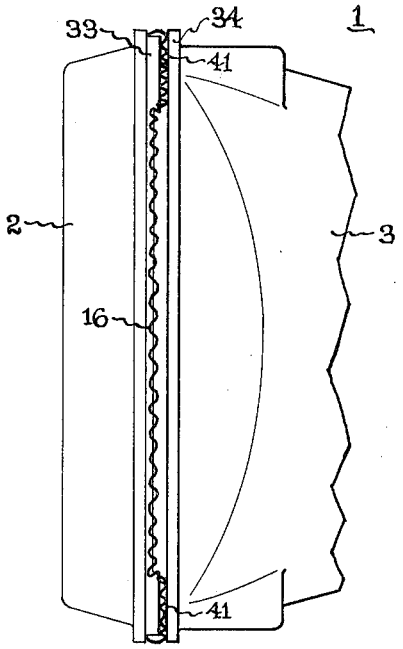
FIG. 4 illustrates a fragmentary side view of the lamp unit in accordance with the present invention.

Furthermore, and as shown in FIG. 4, once lamp unit 1 is assembled, cooperating and opposing keys 33 and key recesses 34 are unable to come into contact with each other due to a space 41 formed therebetween. That is, the keys 33 rise to a height that is less than the depth of the key recesses 34. In a preferred embodiment, the height of the keys 33 is approximately 0.8 millimeters and the depth of the key recesses 34 is approximately 1.0 millimeter resulting in a gap between the sealing surfaces of approximately 0.2 millimeters at and around the corners 12 and 15 of the lens 2 and reflector 3, respectively.

The present invention therefore limits contact to one or more portions of the sealing surface sides exclusively. In particular, the present invention eliminates the prior art practice of the lens and reflector outermost sealing surface sections contacting each other about the lamp unit corners where stresses tend to concentrate. By the present invention isolating lens-reflector contact to one or more portions along the sealing surface sides, stresses generated in the present invention are substantially reduced, as compared to the prior art, and thereby substantially eliminate cracks about the sealing surfaces and especially about the reflector corners. Theoretical explanation accounting for this significant change in the stress pattern is not fully understood, however, test results demonstrate a substantial elimination of cracks, in particular, during decreasing ambient temperatures.

Additionally and as commonly experienced in the art, the lens can warp along its sides resulting in the lens having a much more convex outer face. Such warpage, however, does not affect the present invention inasmuch as a sufficient space is provided between the keys and key recesses to ensure that only the sides of the sealing surfaces can come into contact with each other. That is, even when such warpage occurs, the corners 12 of the lens sealing surfaces are unable to come into contact with the corresponding and opposing reflector sealing surface corners 15.

Furthermore although the present invention has for purposes of description shown all of the keys on one lamp unit sealing surface and the key recesses on the other lamp unit sealing surface, it is to be understood that both keys and key recesses can be on the same sealing surface while remaining within the scope of the present invention. For example, the bottom corners of the lens sealing surface can comprise keys while the top corners thereof can comprise key recesses. Conversely, the bottom corners of the reflector sealing surface would comprise key recesses and the top corners thereof would comprise keys. Such a configuration could be used to ensure that the lens is not placed on the reflector upside down.

By the present invention providing substantially planar sealing surfaces along the sides thereof, a thin ribbon of adhesive can be used thereon and therebetween, providing a substantially uniform spacing between the sealing surfaces, and reducing the amount of adhesive required to seal the envelope together as compared to the prior art. A further advantage of the present invention is in the reduced need for flexibility in the adhesive. That is, at cold temperatures adhesive flexibility is required to reduce the adhesive rigidity and resulting adhesive spalling due to increased stress levels. The present invention by providing preferably planar sealing surface shapes and a uniformly thin ribbon of adhesive can more easily and evenly distribute adhesive stresses created at cold temperatures without requiring as pliable and flexible an adhesive as in the prior art. Thus a lower proportion of flexibilizer can be used as compared to prior art practice.

Another advantage provided by the present invention results directly from the decreased cross-sectional area of adhesive and/or the decreased proportion of flexibilizer required. More particularly, the smaller adhesive cross-sectional area exposed to the surrounding external environment and especially the less flexibilizer required, the less permeable the adhesive is to moisture and other contaminants. That is, the present invention improves the resistance of the lamp unit to moisture and other contaminant penetration and thereby reduces possible filament and lamp degradation therefrom.

Therefore, while preferred embodiments of the invention have been shown and/or described, various other embodiments and modifications thereof will become apparent to persons skilled in the art and fall within the spirit and scope of the invention as defined in the following claims.

I claim:

1. A sealed beam lamp unit comprising a lens and reflector having substantially polygonal peripheries and cooperating and opposing planar sealing surfaces characterized by sides and corners, located approximately about said peripheries and with said planar sealing surfaces being in physical contact along the sides but spaced apart at the corners, with adhesive disposed on and between said planar sealing surfaces wherein a first of said planar sealing surfaces has corners protruding from a plane defined by the sides thereof and cooperating and opposing corners of a second of said planar sealing surfaces, said second planar sealing surface corners indented from a plane defined by the sides thereof, and with each side of said planar sealing surfaces further including reservoirs to contain excess adhesive.

2. A sealed beam lamp unit as defined in claim 1 wherein said peripheries are substantially rectangular.

3. A sealed beam lamp unit as defined in claim 1 wherein each of said sealing surfaces has at least one corner which protrudes and at least one corner which indents from a plane defined by the sides thereof.

4. A sealed beam lamp unit as defined in claim 1 or 3 wherein the heights of said protruding corners as measured from a plane defined by the sides thereof are less than the depths of said indenting corners as measured from a plane defined by the sides thereof.

5. A sealed beam lamp unit as defined in claim 4 wherein the heights of said protruding corners are approximately 0.8 millimeters and the depths of said indenting corners are approximately 1.0 millimeter.

6. A sealed beam lamp unit as defined in claim 1 wherein the distance between said sealing surfaces along said sides is substantially constant.

7. A sealed lamp unit as defined in claim 1 wherein the length of each corner comprises approximately 3.5% of the total lamp unit perimeter as measured at the junction of said sealing surfaces.

8. A sealed beam lamp unit as defined in claim 1 wherein said sealing surfaces are substantially transverse to the lamp unit axis.

9. A sealed beam lamp unit as defined in claim 1, said lens and reflector each formed in a molding operation from two or more tooling pieces, wherein said adhesive avoids contacting portions of said lens and reflector where said tooling pieces have come together during said molding operation.

* * * * *